US007323830B2

(12) United States Patent
Adam et al.

(10) Patent No.: US 7,323,830 B2
(45) Date of Patent: Jan. 29, 2008

(54) LIGHTING ARRANGEMENT HAVING A FLUORESCENT LAMP, PARTICULARLY A COLD CATHODE LAMP

(75) Inventors: Jurgen Adam, Burgau (DE); Robert Weger, Wels (AT)

(73) Assignee: Minebea Co., Ltd., Nagano (JP)

( * ) Notice: Subject to any disclaimer, the term of this patent is extended or adjusted under 35 U.S.C. 154(b) by 22 days.

(21) Appl. No.: 11/259,136

(22) Filed: Oct. 27, 2005

(65) Prior Publication Data

US 2006/0108953 A1 May 25, 2006

(30) Foreign Application Priority Data

Nov. 22, 2004 (DE) ..... 10 2004 056 304

(51) Int. Cl.
*H05B 37/02* (2006.01)

(52) U.S. Cl. ..... 315/291; 315/41

(58) Field of Classification Search ..... 315/41, 315/46, 246, 248, 58, 169.1, 291; 313/491
See application file for complete search history.

(56) References Cited

U.S. PATENT DOCUMENTS

| | | | | |
|---|---|---|---|---|
| 5,420,481 | A * | 5/1995 | McCanney | 315/291 |
| 6,181,071 | B1 | 1/2001 | Yuuki et al. | 315/169.3 |
| 6,184,622 | B1 * | 2/2001 | Lovell et al. | 315/41 |
| 6,191,539 | B1 * | 2/2001 | Green | 315/249 |
| 6,313,585 | B1 * | 11/2001 | Birk | 315/219 |
| 6,515,433 | B1 * | 2/2003 | Ge et al. | 315/227 R |
| 2004/0051431 | A1 | 3/2004 | Murr et al. | 315/291 |

* cited by examiner

*Primary Examiner*—Douglas W. Owens
*Assistant Examiner*—Jimmy Vu
(74) *Attorney, Agent, or Firm*—Duane Morris LLP

(57) ABSTRACT

A lighting arrangement having at least one fluorescent lamp comprising a tube that has at least one light emitting region, a high-voltage terminal at a first end of the tube and a low-voltage terminal at a second end of the tube, an electrically conductive surface being arranged adjacent to the light emitting region of the tube that extends at least partly over the length of the tube, a voltage that corresponds at least approximately to the voltage gradient over the tube being applied to the electrically conductive surface.

21 Claims, 8 Drawing Sheets

LIGHTING ARRANGEMENT HAVING A FLUORESCENT LAMP, PARTICULARLY A COLD CATHODE LAMP

FIELD OF THE INVENTION

Figure 1:
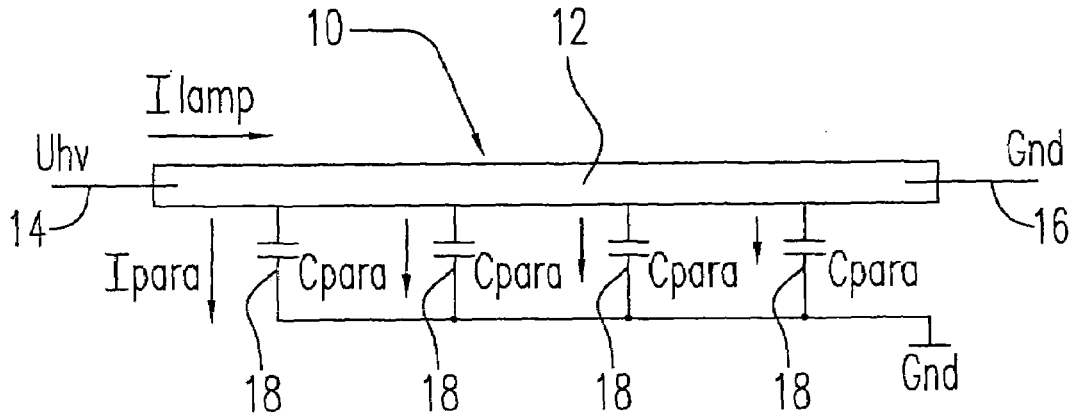

The invention relates to a lighting arrangement having at least one fluorescent lamp, and particularly having a cold cathode lamp, comprising a tube that has at least one light emitting region, a high-voltage terminal at a first end of the tube and a low-voltage terminal at a second end of the tube.

BACKGROUND OF THE INVENTION

Cold cathode lamps are used as a backlight in liquid crystal displays (LCDs), as employed in computer screens for example. Similar backlights are also found in other types of displays in a wide range of applications, such as in motor vehicles, illuminated advertising panels and suchlike.

Cold cathode lamps are generally employed in backlights for LCD screens. They have the advantage of generating a small amount of heat combined with a relatively long useful life and high efficiency. Moreover, the electrode structures are simple making it possible to produce very small cold cathode lamps that can also be used in small liquid crystal displays.

A cold cathode lamp comprises a tube having a high-voltage terminal at a first end of the tube and a low-voltage terminal at the second end of the tube. The high-voltage terminal is supplied with a high-frequency AC voltage, a typical supply voltage having a frequency of approximately 50 to 100 kHz and a voltage amplitude of approximately 500 to 1000 V. The low-voltage terminal is generally connected to ground. However, it is also possible to connect the two cold cathode lamp terminals to a positive and a negative AC voltage, a virtual ground being located at about the center of the tube. This is especially practical for particularly long tubes.

A key criterion for LCDs is to illuminate the entire display surface as uniformly as possible. Depending on the size of the screen, from two to 16, or even more, cold cathode lamps are used for the backlight. The lamps are arranged parallel to each other, vertically above one another and their light is distributed on a liquid crystal plate via a reflector and via a diffuser plate. To achieve the most uniform distribution of brightness that is possible, it is not only necessary for the individual lamps to glow with the same brightness, but each individual lamp in itself must also emit a uniformly bright light along its length. An uneven distribution of brightness over individual lamps is caused by manufacturing tolerances and can be kept under control by selection during the manufacturing process. The causes of uneven brightness over the length of an individual lamp are explained below.

Cold cathode lamps in liquid crystal displays are supplied with a high-frequency AC voltage via an inverter, called a backlight inverter. A reflector directs the light emitted by the lamps onto a diffuser plate which guides and distributes it onto a liquid crystal plate. The liquid crystal plate is generally inserted between two polarization plates. The entire arrangement is held in a frame. The mechanical arrangement of the backlight inverter and the lamps in the liquid crystal display give rise to parasitic capacitances between the fluorescent tube and ground which results in the effective lamp current decreasing from the high-voltage terminal to the low-voltage terminal. This can result in a brightness that diminishes from the high-voltage terminal to the low-voltage terminal. This problem is amplified in the event that the brightness of the fluorescent lamp is lowered by analogue dimming. The lamp current can then drop in the region of the low-voltage terminal to such an extent that the lamp does not emit any light whatsoever in this region. In practice, this means that the parasitic capacitances also limit the useful analogue dimming range.

U.S. Pat. No. 6,670,781 relates to a control circuit for cold cathode lamps for LCDs and deals with the problem that, particularly for analogue dimming, these lamps emit a non-uniform brightness and flicker. To solve this problem, U.S. Pat. No. 6,670,781 proposes a new control method for fluorescent lamps that uses a predetermined number of current pulses. However, U.S. Pat. No. 6,670,781 does not deal with the problem of diminishing brightness along the length of a fluorescent lamp due to parasitic capacitances.

Other fluorescent lamps and particularly cold cathode lamps for liquid crystal displays and associated control devices are described, for example, in U.S. Pat. Nos. 6,538,373 and 6,108,215, just to mention a couple of examples.

It is the object of the invention to provide a lighting arrangement that has a fluorescent lamp and particularly a cold cathode lamp which generates a uniform brightness over its entire length in both normal operation as well as over a wide dimming range.

SUMMARY OF THE INVENTION

This object has been achieved by a lighting arrangement having the characteristics of claim 1.

The lighting arrangement according to the invention has at least one fluorescent lamp and particularly a cold cathode lamp comprising a tube that has at least one light-emitting region, a high-voltage terminal at a first end of the tube and a low-voltage terminal at a second end of the tube. These kinds of tubes are generally straight but can also be bent into a U-shape or they can be given various other shapes depending on the application. In the prior art, parasitic capacitances are formed along the entire length of the tube between the tube and ground, so that the lamp current drops from the high-voltage terminal to the low-voltage terminal. In order to prevent this, the invention provides an electrically conductive surface adjacent to the light-emitting region of the tube that extends substantially along the length of the tube, a voltage that approximately corresponds to the voltage gradient over the tube being applied to the electrically conductive surface. In other words, the essentially linear voltage gradient over the tube is reproduced on the electrically conductive surface so that no substantial potential difference exists between the electrically conductive surface and the tube over the entire length of the tube. This means that no parasitic capacitances that would have an influence on the lamp current can form between the tube and the electrically conductive surface.

The invention is based on a method that is basically known in measuring technology which is called "guarding". The principle of guarding is based on the fact that parasitic currents between two conductive surfaces can only flow when the surfaces carry different potentials. Consequently, in measuring technology, the guards that are used are tied to the same potential as the element to be measured. However, in the prior art each guard is tied to a constant potential, as described, for example, in U.S. Pat. No. 6,147,851.

In this context, guarding should not be confused with the shielding of an electric device. A shield is used to shield magnetic or electric fields and in doing so is tied to a constant reference potential. On the other hand, a guard has the object of making parasitic capacitances ineffective and to this effect is tied to the same voltage potential as the electric device to be guarded.

The inventors have now recognized that the technique of guarding, basically known in measuring technology, can be successfully applied in a modified form in displays, and particularly in liquid crystal displays, for the purpose of maintaining a constant lamp current in a fluorescent lamp. To this effect, it is necessary for the electrically conductive surface, i.e. the guard, to have at least approximately the same voltage gradient as the tube. It is thus not appropriate to provide a guard having a constant voltage potential, as is known in measuring technology.

The electrically conductive surface is preferably arranged at a spacing to the tube, although it could conceivably be applied to the tube as a coating.

In a preferred embodiment of the invention, the electrically conductive surface consists of a flat electrode having a plurality of separate electrode sections, the electrically conductive surface extending substantially over the entire length of the tube from the first to the second end of the tube. The electrode sections are preferably connected to each other by capacitors that form a voltage divider. In this embodiment, the electrically conductive surface is connected at its ends that are associated with the first and the second end of the tube to the high-voltage terminal and to the low-voltage terminal respectively. This provides an arrangement in which the electrically conductive surface is formed from a plurality of electrode sections connected together by means of capacitors, one end of the electrically conductive surface being connected to the high-voltage terminal and the other end being connected to the low-voltage terminal, so that a potential gradient over the electrode sections is produced that substantially corresponds to the potential gradient over the fluorescent tube. The more electrode sections that are provided, the better can the potential gradient over the tube be reproduced. The electrically conductive surface, which has substantially the same voltage gradient as the tube, is disposed in the direct proximity of the tube and prevents parasitic capacitances from being formed between the tube and the surroundings. Then again, in practice, parasitic capacitances act on the electrically conductive coating since it has a potential difference to the surroundings, i.e. ground. These parasitic capacitances, however, only affect the voltage gradient in the guard and consequently do not directly affect the lamp current or the brightness of the fluorescent lamp.

In another embodiment of the invention, the electrically conductive surface is divided into a plurality of sections that are disposed along the tube. Each section is coupled to a different voltage potential, the sections, however, not being connected directly to each other using a voltage divider. A section of the electrically conductive surface that lies closer to the high-voltage terminal of the tube would have a voltage potential that is higher than the voltage potential of a section that lies closer to the low-voltage terminal of the tube. This extremely simple embodiment, however, has the disadvantage that a separate voltage supply, which can be derived from the high-voltage terminal, has to be provided for each section of the electrically conductive surface. It is also possible, of course, to provide a capacitive voltage divider for this simple embodiment.

In a particularly simple embodiment of the invention, two sections are provided, the section lying closer to the high-voltage terminal having a potential of approximately ¾ of the high voltage, and the section lying closer to the low-voltage terminal having a potential of approximately ⅜ of the high voltage. Taking the example of a high-voltage terminal that is supplied with an 800 V AC voltage and a low-voltage terminal that is tied to ground, in this simple embodiment the potential of the first section of the electrically conductive surface is approx. 600 V and the potential of the second section of the electrically conductive surface is approx. 300 V. Assuming that the two sections of the electrically conductive surfaces each extend over half the length of the tube, the potential difference between the tube and the electrically conductive surface is never more than 200 V, which means that parasitic capacitances can be significantly reduced.

In an embodiment of the invention, the electrically conductive surface is essentially even and extends parallel to the fluorescent tube substantially over its entire length. If the lighting arrangement comprises a plurality of adjacent fluorescent tubes, the electrically conductive surface can be so designed as to extend parallel to the plurality of fluorescent tubes.

In another embodiment of the invention, the electrically conductive surface is substantially U-shaped and can be partially placed about a fluorescent tube. Whereas the first-mentioned embodiment is relatively simple to manufacture, the second embodiment has the advantage that parasitic capacitances between the fluorescent tube and ground can be reduced to an even greater extent.

In a particularly expedient embodiment of the invention, the electrically conductive surface is mounted onto a circuit board or embedded in a circuit board.

The invention also provides a liquid crystal display having at least one lighting device of the type described above. The liquid crystal display comprises a reflector that reflects the light emitted by the fluorescent lamp onto a diffuser plate, the diffuser plate and a liquid crystal plate downstream from the diffuser plate. The liquid crystal plate can be associated with one or more polarization plates. The components of the liquid crystal plate form a layered structure and are generally held in a frame. According to the invention, the electrically conductive surface can either be integrated into one of these layers or mounted onto such. For example, the electrically conductive surface can be mounted onto the reflector or form the reflector itself. In another embodiment, the electrically conductive surface can be formed by an electrically conductive layer formed on the diffuser plate.

SHORT DESCRIPTION OF THE DRAWINGS

Figure 2:
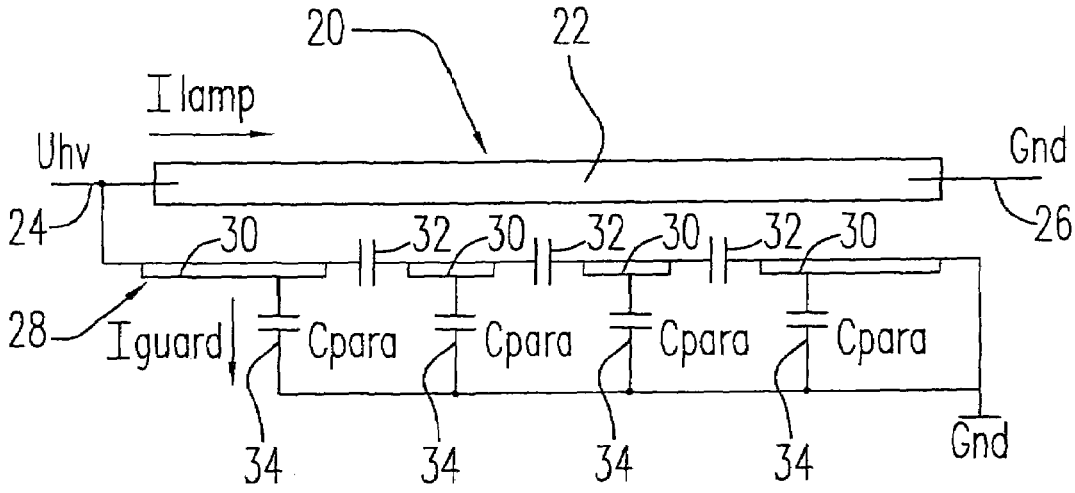
Figure 3:
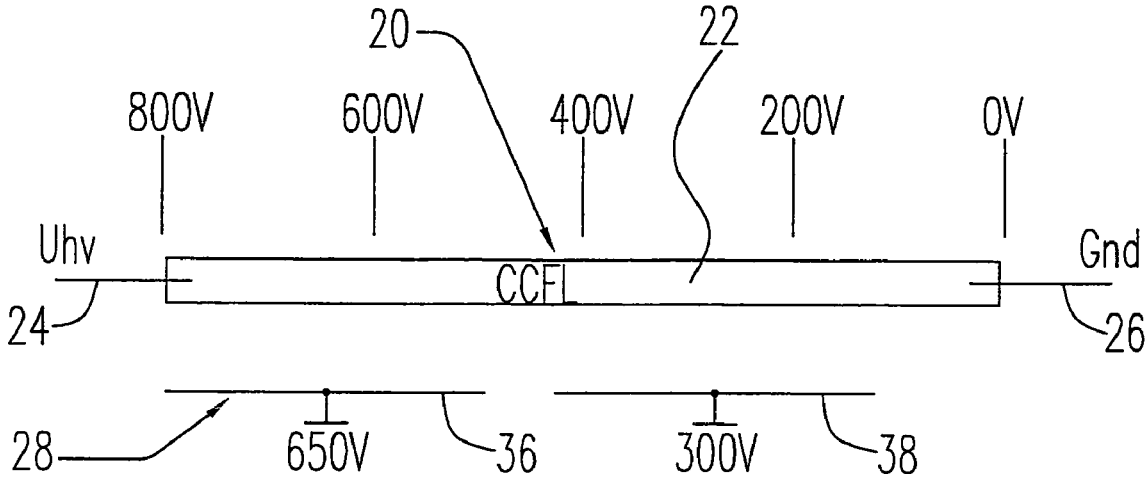
Figure 4:
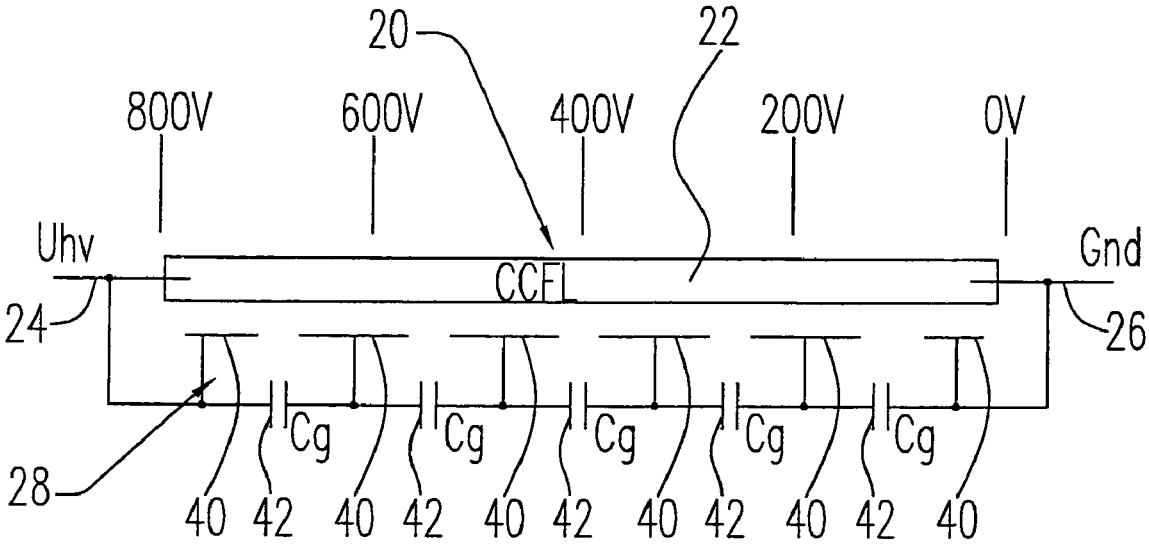
Figure 5:
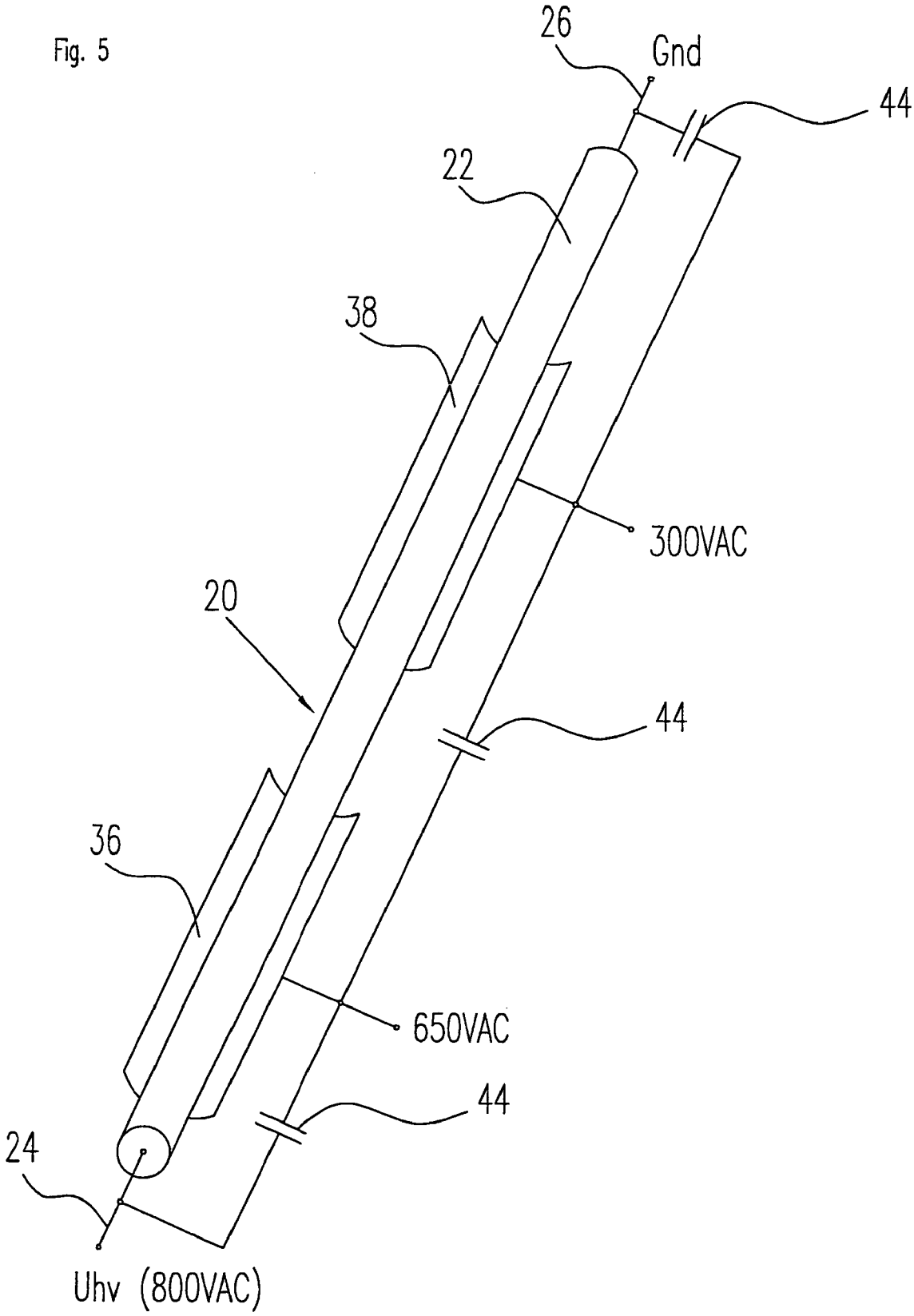
Figure 6:
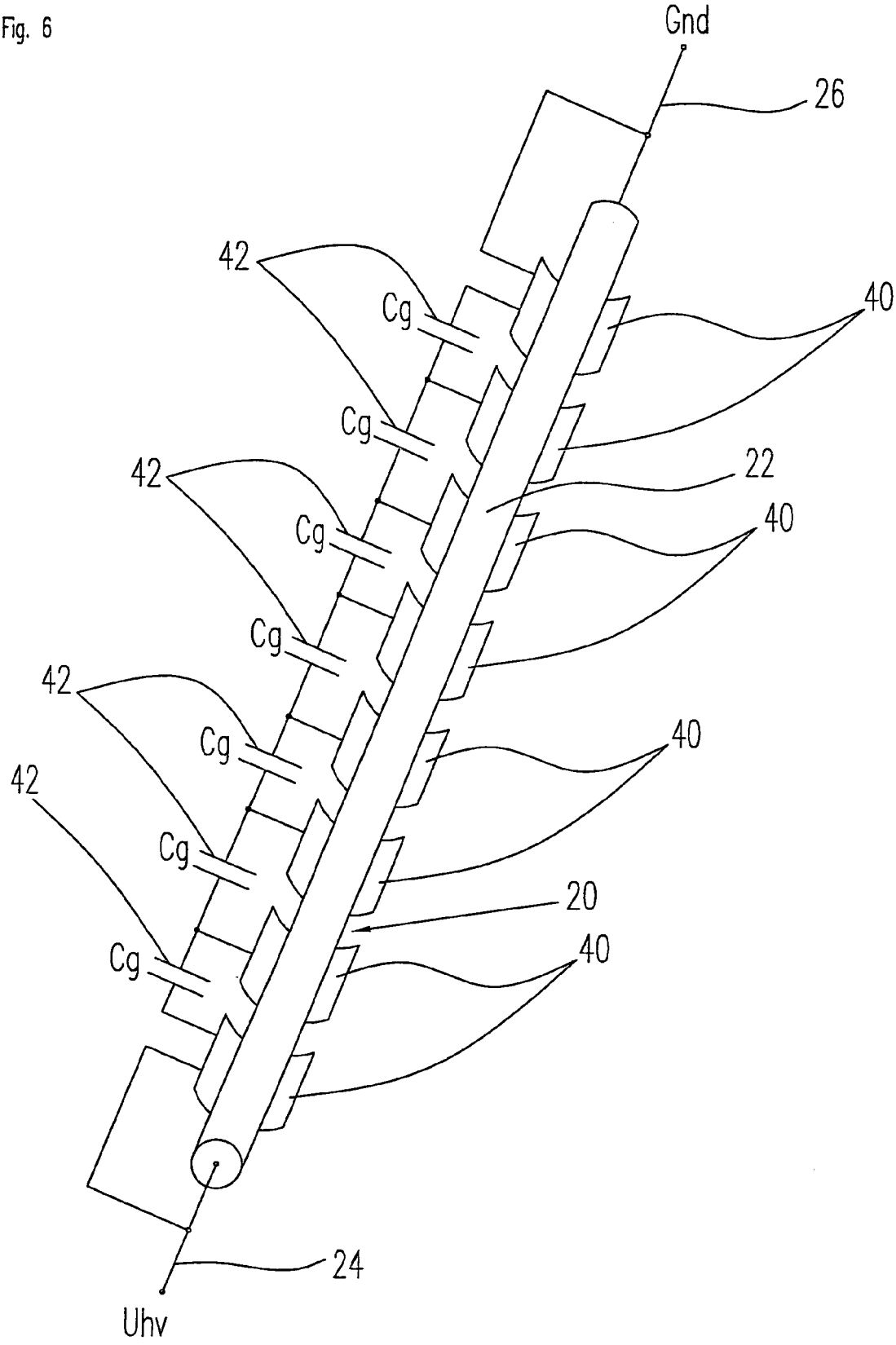
Figure 7:
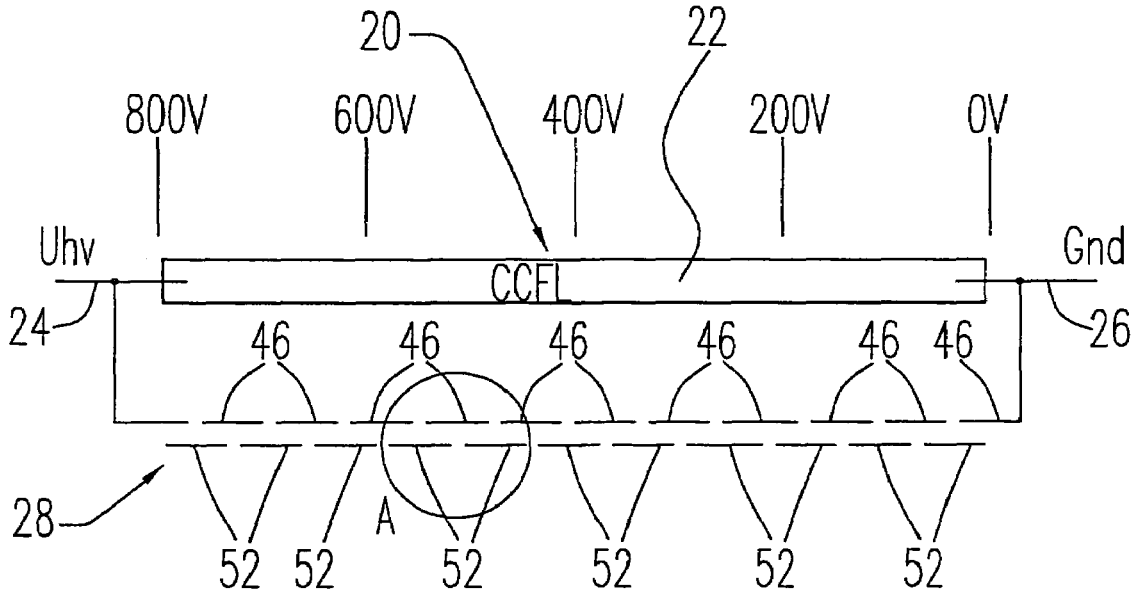
Figure 8:
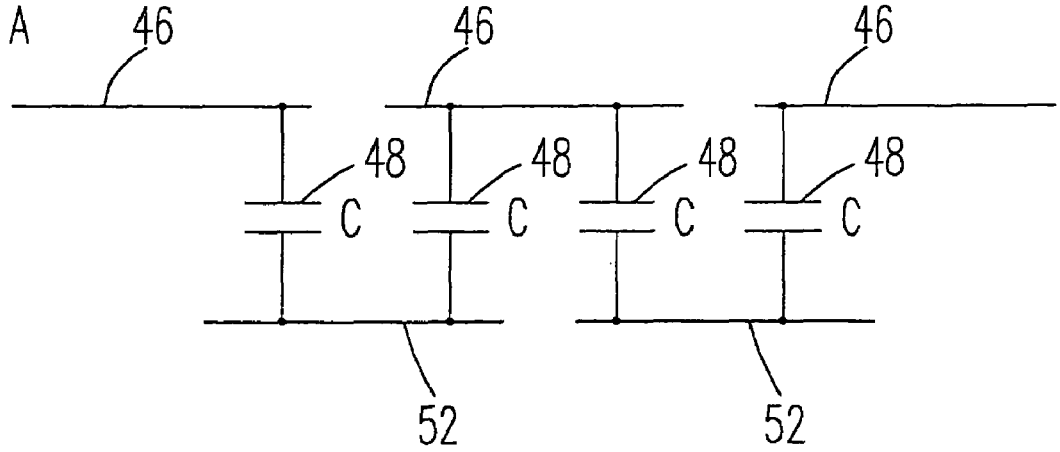
Figure 9:
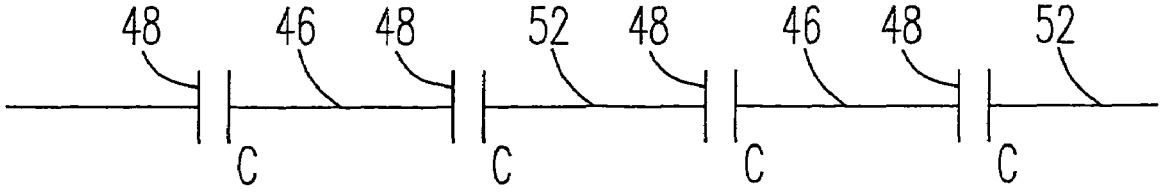
Figure 10:
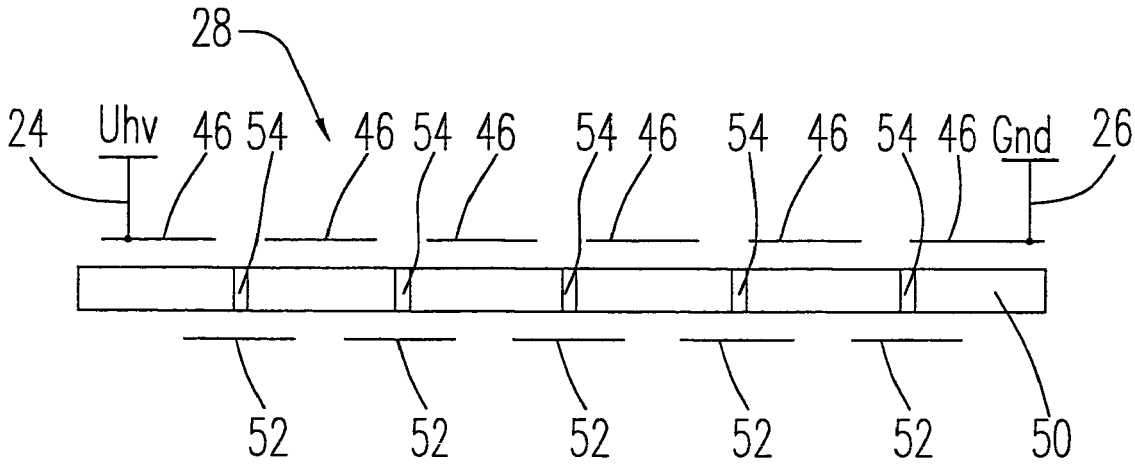
Figure 11:
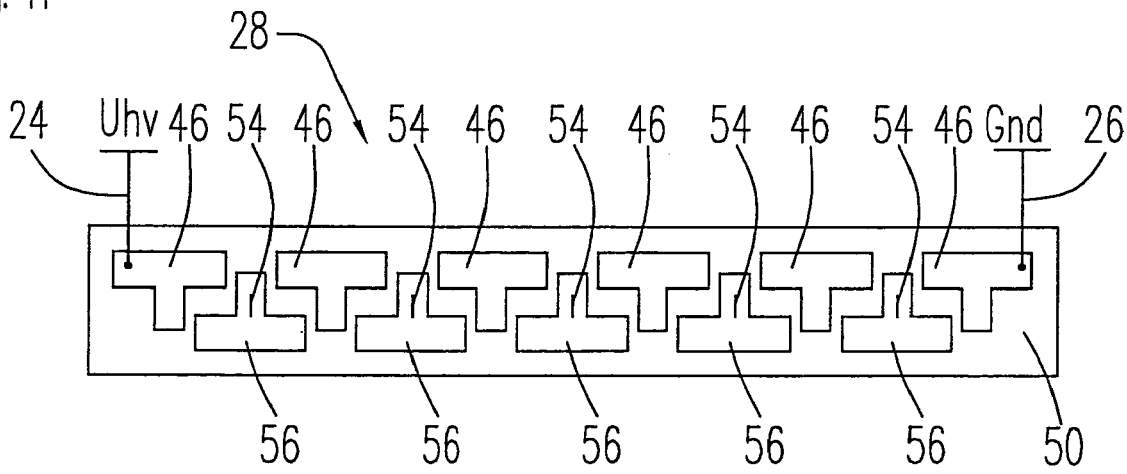
Figure 12:
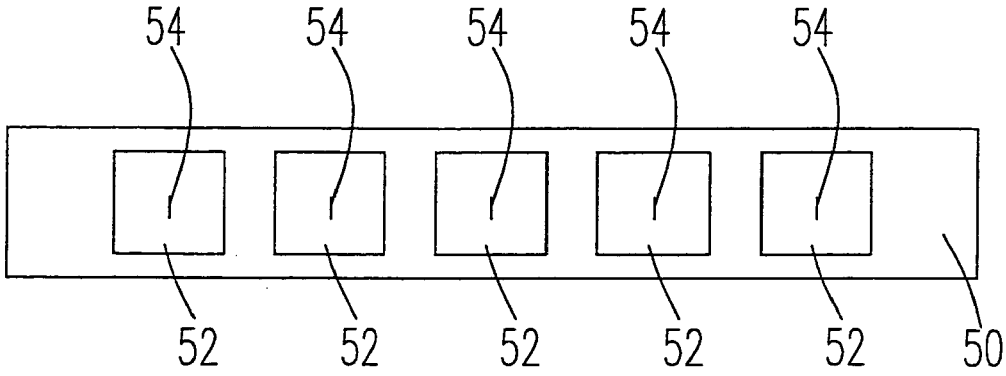
Figure 13:
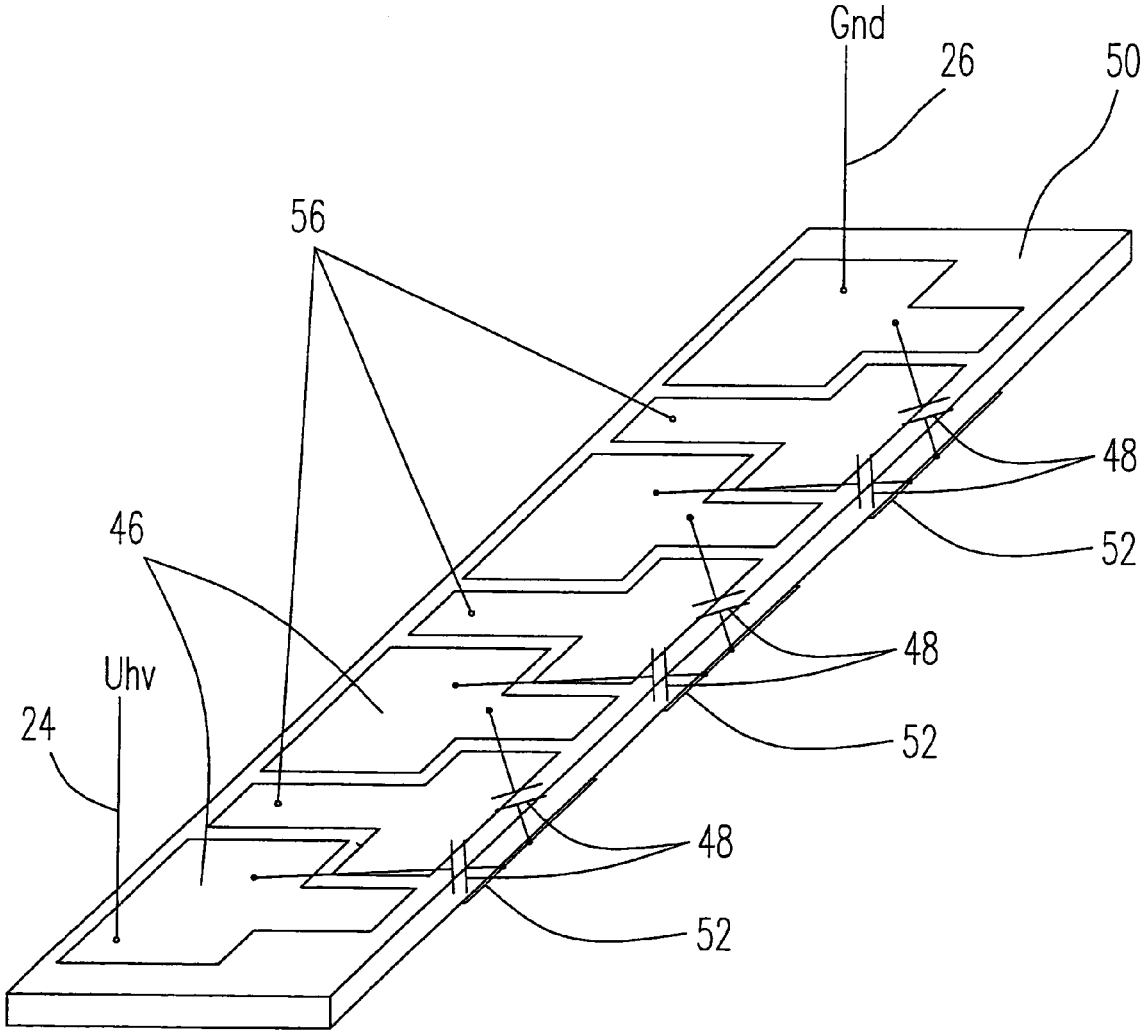
Figure 14:
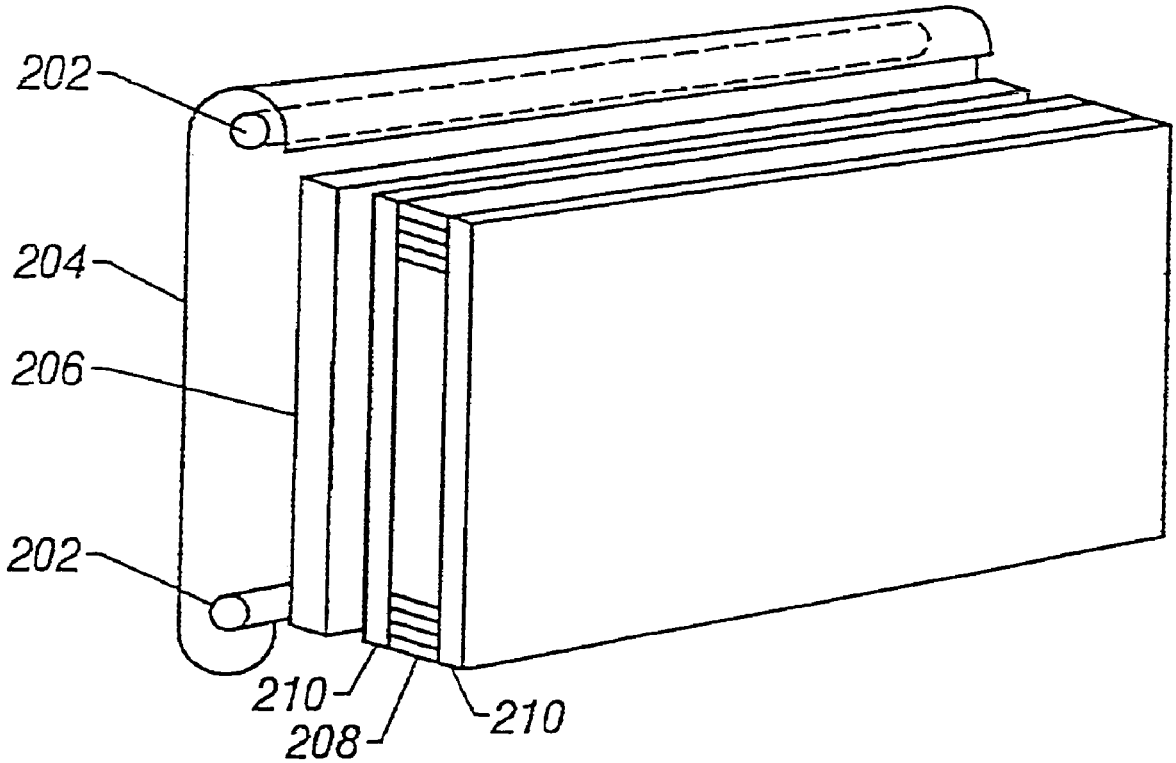
Fig. 14 (Prior art)

Other features and advantages of the invention can be derived from the following description with reference to the drawings. The figures show:

FIG. 1 a schematic view of a fluorescent lamp according to the prior art to explain the problem underlying the invention;

FIG. 2 a schematic view of a lighting arrangement having a fluorescent lamp according to the invention;

FIG. 3 a schematic view of a second embodiment of the lighting arrangement according to the invention;

FIG. 4 a schematic view of a third embodiment of the lighting arrangement according to the invention;

FIG. 5 a simplified perspective view of a lighting arrangement according to the second embodiment of the invention;

FIG. 6 a simplified perspective view of a lighting arrangement according to the third embodiment of the invention;

FIG. 7 a schematic view of a further embodiment of the lighting arrangement according to the invention;

FIG. 8 an enlarged detailed view of the embodiment of FIG. 7 for explanatory purposes;

FIG. 9 a further schematic view of the embodiment of FIG. 7 for explanatory purposes;

FIG. 10 a schematic section through a circuit board structure for the realization of the embodiment of FIG. 7;

FIG. 11 a view from above of the circuit board structure of FIG. 10; and FIG. 12 a view from below of the circuit board structure of FIG. 10;

FIG. 13 a simplified perspective view of the circuit board structure of FIG. 10; and FIG. 14 a schematic perspective view of a liquid crystal display according to the prior art.

DETAILED DESCRIPTION OF PREFERRED EMBODIMENTS

FIG. 14 schematically shows the components of a typical liquid crystal display according to the prior art. The liquid crystal display comprises one or more fluorescent tubes, particularly cold cathode lamps 202, a reflector 204, a diffuser plate 206, a liquid crystal plate 208 and polarization plates 210 in which the liquid crystal plate 208 is embedded. The cold cathode lamps 202 have an AC power supply that is not shown in the figure. A backlight inverter, also not shown in the figure, converts a DC voltage into an AC voltage to control the cold cathode lamp 202. Normally, a control circuit (not illustrated) is also provided that regulates the current delivered to the cold cathode lamp 202. The lighting arrangement according to the invention can be used, for example, as a backlight in a liquid crystal display of this kind.

FIG. 1 shows a fluorescent lamp 10 according to the prior art. The fluorescent lamp 10 is a cold cathode lamp (CCFL), for example, that has a tube 12 with a high-voltage terminal 14 and a low-voltage terminal 16. The high-voltage terminal 14 is connected to a power source (not illustrated) that delivers a high-frequency AC voltage (operating voltage $U_{hv}$) in the range of e.g. 500 to 1000 V at approximately 50 to 100 kHz. The low-voltage terminal 16 is preferably connected to ground. When the operating voltage ($U_{hv}$) is applied to the tube 12, a lamp current $I_{lamp}$ flows through the tube. Moreover, parasitic capacitances $C_{para}$ 18 are built up over the length of the lamp between the tube 12 and ground, through which a parasitic current $I_{para}$ flows to ground. The parasitic capacitances 18 cause the lamp current $I_{lamp}$ to drop from the high-voltage terminal 14 to ground 16. This gives the fluorescent lamp 10 a non-uniform brightness over its length.

FIG. 2 shows a schematic view of the lighting arrangement according to the invention. The lighting arrangement comprises at least one fluorescent lamp 20, particularly a cold cathode lamp, which has a tube 22, a high-voltage terminal 24 and a low-voltage terminal 26. An electrically conductive surface (guard) 28 is provided parallel to the fluorescent tube 22, the electrically conductive surface having a plurality of conductive sections or electrode sections 30. The electrode sections are connected to each other by means of capacitors 32 and together form the electrically conductive surface 28 that is connected to the high-voltage terminal 24 and the low-voltage terminal (ground in the illustrated embodiment) 26.

In addition to the illustrated capacitors 32, in a modification of the illustrated embodiment another capacitor can be provided between the high-voltage terminal 24 and the electrode section 30 located closest to the high-voltage terminal 24 as well as between the low-voltage terminal 26 and the electrode section 30 located closest to the low-voltage terminal.

The electrode sections 30 and the capacitors 32 are configured such that the electrode sections 30 carry an AC voltage potential that corresponds largely to the AC voltage potential in the opposing region of the tube 22 of the fluorescent lamp 20. As a result, potential differences between the electrically conductive surface 28 and the tube 22 can be minimized. The illustrated embodiment shows that the electrode sections 30 of the electrically conductive surface 28 need not necessarily be the same size nor do they need to be regularly arranged. It is also possible for a guard not to be provided over the end region of the tube 22 adjoining the low-voltage terminal 26, since in this region the potential difference to ground is low even without a guard. A person skilled in the art would be able to find a suitable arrangement without an inordinate amount of effort. The capacitors 32 are preferably, but not necessarily, the same size to allow a largely even distribution of the operating AC voltage at the high-voltage terminal 24 over the length of the electrically conductive surface 28.

The aim of the arrangement is to ensure that at least approximately one potential gradient is generated on the electrically conductive surface 28 that corresponds to the potential gradient over the tube 22, so that only low parasitic capacitances are formed between the tube 22 and the electrically conductive surface 28 or the electrode sections 30. This goes to reduce the parasitic currents so that the lamp current $I_{lamp}$ is almost constant over the entire length of the tube 22 from the high-voltage terminal 24 to the low-voltage terminal 26. This means that the fluorescent lamp 20 can emit a more uniform amount of light over its entire length.

As shown in FIG. 2, parasitic capacitances $C_{para}$ 34 are formed between the electrically conductive surface 28 and ground. However, these do not directly influence the current through the fluorescent lamp 20 and consequently do not influence the distribution of brightness in the fluorescent lamp either.

It is expedient if the electrically conductive surface 28 is arranged in such a way that it is disposed between the tube 22 and a ground potential carrying frame, for example, or another nearby component of the lighting arrangement that is tied to the ground potential.

FIG. 3 schematically shows another embodiment of the lighting arrangement according to the invention.

In this embodiment, an AC voltage of 800 V is applied to the high-voltage terminal 24 of the fluorescent lamp 20, and the low-voltage terminal 26 is tied to ground. The gradient of the voltage potential over the length of the fluorescent lamp 20 is indicated schematically by the voltage amplitudes 800 V, 600 V, 400 V, 200 V and 0 V. In practice, the voltage gradient over the length of the tube 22 is approximately, but not necessarily, completely linear.

In the embodiment of FIG. 3, only two electrode sections are provided that are tied to a fixed AC voltage potential that is in phase with the AC voltage at the fluorescent tube 22. An appropriate arrangement of the two electrode sections 36, 38 and a suitable choice of potential means that, in the illustrated embodiment, the voltage difference between the electrically conductive surface 28, consisting of the two electrode sections 36, 38, and the fluorescent tube 22 is never larger than 150 V, for example. To this effect, the electrode section 36 is arranged in such a way that it is located opposite the region of the fluorescent tube 22 that carries a potential of between 800 and 500 V, this electrode section 36 having an AC voltage of 650 V. The second electrode section 38 is located opposite a region of the fluorescent tube 22 that carries a voltage of 500 to 150 V, and itself has an AC voltage of 300 V. No electrode section is associated with the region of the fluorescent tube that carries a voltage of 150 to 0 V, which means that it is located directly opposite ground. Due to this very simple construction, the maximum potential difference between the fluorescent tube 200 and ground is reduced from 800 V to 150 V, so that correspondingly lower parasitic capacitances and parasitic currents arise. The embodiment illustrated in FIG. 3 has the advantage that it is very simply constructed but it has the disadvantage, however, that it is necessary to ensure that the AC voltages applied to the electrode sections 36, 38 are in phase with the supply AC voltage at the high-voltage terminal 24, otherwise the parasitic effects could even increase.

FIG. 4 shows a further embodiment of the lighting arrangement according to the invention which is similar to the embodiment of FIG. 2. The fluorescent tube 22 is connected between an AC voltage of 800 V, for example, and ground. An electrically conductive surface 28 is provided parallel to the fluorescent tube 22 which has a plurality of electrode sections 40 that are coupled to one another via capacitors 42. As can be seen from FIG. 4, the electrode sections 40 are not distributed evenly over the length of the fluorescent tube 22 in order to reproduce a non-linear voltage gradient over the length of the tube. Capacitors 42 of the same size are preferably used in order to form a uniform voltage divider. The number of electrode sections 40 and thus the number of capacitors 42 can be freely chosen to allow as fine a gradation of the potential gradients on the electrically conductive surface 28 as required. Due to the capacitors 42, only a small reactive current is drawn from the power source of the fluorescent lamp 20. The capacitors 42 are considerably larger than the parasitic capacitances that would form between the electrically conductive surface 28 and ground (see FIG. 2). Since no ohmic loads or inductances are provided, this ensures that the voltage at the electrode sections 40 has the same phase as the input AC voltage at the high-voltage terminal 24. The capacitors 42 preferably have a capacitance in the range of a few picofarad (pF). The choice of capacitor, however, depends on the number of electrode sections 40 as well as the supply voltage at the high-voltage terminal 24.

FIGS. 5 and 6 schematically show a practical embodiment for the lighting arrangements of FIGS. 3 and 4. Corresponding elements are indicated by the same reference number and are not described again here. In this embodiment, the electrode sections 36, 38, 40 are made of thin bent metal plates that are connected to one another via capacitors 42, 44. Three capacitors 44 are shown in FIG. 5 that form a voltage divider to derive the AC voltages at the electrode sections 36 and 38 from the operating voltage ($U_{hv}$). Alternatively, the electrode sections 36, 38 could receive their supply voltages from additional external sources.

FIG. 7 schematically shows how a lighting arrangement according to the invention can be constructed in practice in an alternative embodiment. The embodiment illustrated in FIG. 7 basically corresponds to the embodiment that was described with reference to FIG. 4. The lighting arrangement of FIG. 7 comprises a fluorescent lamp 20 which consists of a tube 22 having a high-voltage terminal 24 and a low-voltage terminal 26. As in FIG. 4, the potential gradient of the tube 22 is also schematically indicated in FIG. 7 by the voltage values 800 V, 600 V, 400 V, 200 V, 0 V. An electrically conductive surface 28, formed from two groups of electrode sections 46, 52, is arranged parallel and adjacent to the tube 22. The electrode sections 46, 52 are coupled via capacitors 48 as shown in FIG. 8, which is an enlarged view of detail A in FIG. 7. FIG. 9 shows a schematic equivalent circuit diagram of the electrode arrangement of FIGS. 7 and 8.

The embodiment of FIGS. 7 to 9 can be realized in the way shown in FIGS. 10 to 13, wherein FIGS. 10 to 13 only show the electrically conductive surface 28. The electrode sections 46 are formed by electric conductors that are mounted on the top of a circuit board 50 or embedded in this board. The capacitors 48, shown schematically in FIG. 13, are formed in that the electrode sections 46 are associated with other electrode sections 52 on the opposite side (bottom) of the circuit board 50, the electrode sections 46 on the top of the circuit board 50 and the other electrode sections 52 on the bottom of the circuit board 50 each acting as capacitor plates that form a capacitor 48 between them, as indicated in FIG. 13. Here, the material of the circuit board 50 acts as a dielectric. The circuit board 50 can be made, for example, of FR4, fiber glass impregnated with epoxy resin, plastic films, Kapton or any other suitable materials.

In a first version, only the electrode sections 46 on the top of the circuit board 50 form the electrically conductive surface 28 that extends parallel to the tube 22 and is adjacent to it. It is connected at the high-voltage terminal 24 and at the low-voltage terminal 26. The electrode sections 46 thus show approximately the same potential gradient as the tube 22 that is tied to the same connections 24, 26. In order to give the potential gradient of the electrically conductive surface 28 an even finer resolution, it is possible to connect the electrode sections 52 on the bottom of the circuit board 50 to the top of the circuit board 50 via through connectors 54. For this purpose, counter electrodes 56 are formed on the top of the circuit board 50.

The circuit board 50, on which or in which the electrically conductive surface 28 according to the invention is formed, is arranged in a liquid crystal display with its top surface adjoining a fluorescent lamp 20, for example, in place of the reflector. For this purpose, the circuit board 50 can be given a reflecting surface.

If, for example, a plurality of fluorescent lamps, and particularly cold cathode lamps, are arranged parallel to each other in a liquid crystal display in order to form a backlight, the circuit board 50 can be modified such that it extends parallel to all the fluorescent lamps, the electrode sections 46, 52, 56 being formed from strips which run perpendicular to the longitudinal axis of each fluorescent tube 22. By choosing suitable material for the circuit board 50 and the electrode sections 46, 52, they can also form a part of a diffuser plate in an LC-display provided that the optical requirements placed on a diffuser plate are met.

The lighting arrangement according to the invention makes it possible to create a backlight for a liquid crystal display which is formed from a plurality of fluorescent lamps, particularly cold cathode lamps, and which emits a constant light intensity over its entire length. By giving the electrically conductive surface the same potential gradient as the tube, parasitic capacitances between the tube and ground can be largely prevented. This makes it possible for the fluorescent tube to have a uniform brightness even when the tube is dimmed, i.e. when it is supplied with a lower AC voltage than its operating voltage. Other disturbing effects, such as flickering or pattern formation by the fluorescent lamps can be prevented.

The power consumption of the electrically conductive surface is exceptionally small, drawing only reactive current from the power supply of the fluorescent lamp due to the capacitive coupling of the electrode sections. According to the expectations of the inventor, the power consumption will lie in the range of 1% to 5% of the overall power consumption of the fluorescent lamp.

The invention not only provides a larger analogue dimming range for fluorescent lamps but also allows larger lamp lengths to be realized than in the prior art, wherein the length of the fluorescent lamps could reach 1 m or more.

The invention can basically be applied to all fluorescent tubes that are operated with a relatively high-frequency alternating high voltage lying, for example, in the range of 50 to 100 kHz and 500 to 1000 V. Since problems involving a non-uniform brightness gradient over the length of the fluorescent tube arise in practice only from lengths of over 30 cm, the invention can be particularly meaningfully employed in fluorescent tubes having an extended length of over 30 cm. The invention can also be applied to bent or spiral-shaped tubes or tubes taking some other form in which the problem of parasitic capacitances, and thus parasitic currents, can be greater than for straight tubes.

The capacitances to build a voltage divider for the electrically conductive surface should be at least two orders of magnitudes larger than the expected parasitic capacitances; depending on the voltage steps between two adjacent electrode sections, they will range in the order of magnitude of a few picofarad (pF).

The electrically conductive surface can basically be formed as a film or thin plate or integrated in a circuit board. In a liquid crystal display, it can be arranged on the back of the fluorescent lamp in which case it should be reflective, or on the front, in which case it should be transparent.

The features revealed in the above description, the claims and the figures can be important for the realization of the invention in its various embodiments both individually and in any combination whatsoever.

IDENTIFICATION REFERENCE LIST

10 Fluorescent lamp
12 Tube
14 High-voltage terminal
16 Low-voltage terminal, ground
18 Parasitic capacitances
20 Fluorescent lamp
22 Tube
24 High-voltage terminal
26 Low-voltage terminal, ground
28 Electrically conductive surface (guard)
30 Electrode sections
32 Capacitors
34 Parasitic capacitances
36, 38 Electrode sections
40 Electrode sections
42 Capacitors
44 Capacitors
46 Electrode sections
48 Capacitors
50 Circuit board
52 Electrode sections
54 Through connectors
56 Counter electrode
202 Cold cathode lamp
204 Reflector
206 Diffuser plate
208 Liquid crystal plate
210 Polarization plates
$I_{lamp}$ Lamp current
$U_{hv}$ Operating voltage
Gnd Ground
$C_{para}$ Parasitic capacitances
$I_{para}$ Parasitic current

The invention claimed is:

1. A lighting arrangement having at least one fluorescent lamp comprising a tube that has at least one light emitting region, a high-voltage terminal at a first end of the tube and a low-voltage terminal at a second end of the tube, wherein an electrically conductive surface is arranged adjacent to the light emitting region of the tube that extends at least partly over the length of the tube, a voltage that corresponds at least approximately to the voltage gradient over the tube being applied to the electrically conductive surface, said electrically conductive surface formed from a flat electrode having a plurality of electrode sections that substantially extend from the first to the second end of the tube, wherein the electrode sections are connected to each other by capacitors, the capacitors forming a voltage divider.

2. A lighting arrangement according to claim 1, wherein the electrically conductive surface is spaced from the tube.

3. A lighting arrangement according to claim 1, wherein the electrically conductive surface has a high-voltage terminal and a low-voltage terminal respectively at the ends associated with the first and the second end of the tube.

4. A lighting arrangement according to claim 1, wherein said plurality of sections are coupled to a different voltage potential.

5. A lighting arrangement according to claim 1, wherein the electrically conductive surface is substantially even.

6. A lighting arrangement according to claim 1, wherein the electrically conductive surface is substantially U-shaped and placed around the tube.

7. A lighting arrangement according to claim 1, wherein the electrically conductive surface is mounted on a circuit board or embedded in a circuit board.

8. A lighting arrangement according to claim 1, wherein the high voltage is a high-frequency AC voltage.

9. A lighting arrangement according to claim 1, wherein at least one fluorescent lamp is a cold cathode lamp.

10. A backlight for a display having the lighting arrangement of claim 1.

11. A lighting arrangement having at least one fluorescent lamp comprising a tube that has at least one light emitting region, a high-voltage terminal at a first end of the tube and a low-voltage terminal at a second end of the tube, wherein an electrically conductive surface is arranged adjacent to the light emitting region of the tube that extends at least partly over the length of the tube, a voltage that corresponds at least approximately to the voltage gradient over the tube being applied to the electrically conductive surface, said electrically conductive surface having a plurality of sections that are disposed along the length of the tube, each section being coupled to a different voltage potential, wherein a first section of the electrically conductive surface, that lies closer to the high-voltage terminal of the tube is coupled to a first voltage potential that lies in the range of [1 to 0.5] ×high voltage, and a second section of the electrically conductive surface that lies closer to the low-voltage terminal of the tube, is coupled to a second voltage potential that lies in the range of [0 to 0.5] ×high voltage, the low voltage corresponding to the ground potential.

12. A lighting arrangement according to claim 11, wherein the first voltage potential is approximately ¾ of the high voltage and the second voltage potential is approximately ⅜ of the high voltage.

13. A lighting arrangement according to claim 11, wherein the electrically conductive surface is spaced from the tube.

14. A lighting arrangement according to claim 11, wherein the electrically conductive surface is substantially even.

15. A lighting arrangement according to claim 11, wherein the electrically conductive surface is substantially U-shaped and placed around the tube.

16. A lighting arrangement according to claim 11, wherein the electrically conductive surface is mounted on a circuit board or embedded in a circuit board.

17. A lighting arrangement according to claim 11, wherein the high voltage is a high-frequency AC voltage.

18. A lighting arrangement according to claim 11, wherein at least one fluorescent lamp is a cold cathode lamp.

19. A backlight for a display having the lighting arrangement of claim 11.

20. A liquid crystal display having a lighting arrangement comprising a tube that has at least one light emitting region, a high-voltage terminal at a first end of the tube and a low-voltage terminal at a second end of the tube, wherein an electrically conductive surface is arranged adjacent to the light emitting region of the tube that extends at least partly over the length of the tube, a voltage that corresponds at least approximately to the voltage gradient over the tube being applied to the electrically conductive surface, wherein at least one fluorescent lamp is a cold cathode lamp, and further comprising a reflector that reflects the light emitted by the fluorescent lamp onto a diffuser plate, the diffuser plate and a liquid crystal plate downstream from the diffuser plate, the fluorescent lamp, the diffuser plate and the liquid crystal plate being held in a frame, wherein the electrically conductive surface is formed by an electrically conductive layer applied to the reflector.

21. A liquid crystal display having a lighting arrangement comprising a tube that has at least one light emitting region, a high-voltage terminal at a first end of the tube and a low-voltage terminal at a second end of the tube, wherein an electrically conductive surface is arranged adjacent to the light emitting region of the tube that extends at least partly over the length of the tube, a voltage that corresponds at least approximately to the voltage gradient over the tube being applied to the electrically conductive surface, wherein at least one fluorescent lamp is a cold cathode lamp, and further comprising a reflector that reflects the light emitted by the fluorescent lamp onto a diffuser plate, the diffuser plate and a liquid crystal plate downstream from the diffuser plate, the fluorescent lamp, the diffuser plate and the liquid crystal plate being held in a frame, wherein the electrically conductive surface is formed by an electrically conductive layer applied to the diffuser plate.

* * * * *